US005129491A

United States Patent [19]

Seidman

[11] Patent Number: 5,129,491

[45] Date of Patent: Jul. 14, 1992

[54] PORTABLE CLOSET FOR STORING, TRANSPORTING, AND DISPLAYING CLOTHING

[76] Inventor: Elizabeth A. Seidman, 2440 140th NE., #55, Bellevue, Wash. 98005

[21] Appl. No.: 717,608

[22] Filed: Jun. 19, 1991

[51] Int. Cl.[5] ..... A45C 5/14; A45C 5/12; A45C 13/30

[52] U.S. Cl. ..... 190/18A; 190/13 R; 190/27; 190/16; 312/199

[58] Field of Search ..... 190/13 R, 14, 15.1, 190/19, 20; 312/199; 217/8, 11; 206/279, 282, 283, 290, 291, 292, 289

[56] References Cited

U.S. PATENT DOCUMENTS

| | | | |
|---|---|---|---|
| 676,594 | 6/1901 | Vogel | 312/199 |
| 900,164 | 10/1908 | Haas | 190/16 |
| 906,153 | 12/1908 | Von Ohlen | 312/199 |
| 1,180,496 | 4/1916 | Heilman | 190/13 R |
| 1,322,901 | 11/1919 | Heinlein, Sr. | 190/16 |
| 1,565,260 | 12/1925 | Cooper | 190/13 R |
| 2,584,438 | 2/1952 | Du Boff et al. | 220/476 X |
| 3,858,693 | 1/1975 | DuBenko | 190/16 |

FOREIGN PATENT DOCUMENTS

| | | | |
|---|---|---|---|
| 644693 | 10/1928 | France | 190/13 R |
| 847760 | 10/1939 | France | 312/199 |
| 2570938 | 4/1986 | France | 190/13 R |
| 316961 | 8/1929 | United Kingdom | 312/199 |

*Primary Examiner*—Sue A. Weaver
*Attorney, Agent, or Firm*—Christensen, O'Connor, Johnson & Kindness

[57] ABSTRACT

A box for storing, transporting, and displaying clothes having front and rear portions, the front portion being divided into left and right portions, a first hanger rod located in the rear portion, and second and third rods located inside the left and right portions of the front portion, where when the left and right portions are fully opened, the first, second and third hanger rods form a substantially continuous hanger rod extending across the combined width of the left, right and rear portions.

8 Claims, 1 Drawing Sheet

PORTABLE CLOSET FOR STORING, TRANSPORTING, AND DISPLAYING CLOTHING

FIELD OF THE INVENTION

This invention relates generally to the field of containers such as portable closets, trunks, etc. useful for containing clothes.

BACKGROUND OF THE INVENTION

A number of portable wardrobes or trunks have ben devised for transporting objects, especially clothes.

For example French Patent 847,760 to Zannetti discloses a wardrobe that includes a rear portion and a front portion. The front portion is of lesser depth than the rear portion, and consists of right and left doors that are hinged to opposing side walls of the rear portion. Therefore, the doors can be opened to a position where the doors are aligned with the parallel to the rear portion. Clothes rods extend across the widths of the doors. The rear portion is divided into left and right compartments. The left compartment is provided with a clothes rod that extends from the front to the back of the compartment; the right compartment is furnished with shelves and drawers. Due to its construction, this wardrobe is useful only as a storage closet for clothes and not for transportation or display of clothes so stored.

U.S. Pat. No. 900,164 discloses a necktie case with upper and lower halves of approximately equal depths that are hinged to each other like a clam shell. A rod extends across the width of each half and is used for holding neckties.

U.S. Pat. No. 3,858,693 discloses a shoe display case with clam shell-hinged halves of approximately equal depths.

U.S. Pat. No. 906,153 discloses a wardrobe trunk with clam shell-hinged front and rear portions of approximately equal depth. A hanger rack is pivoted on the rear portion and includes upper and lower parallel clothes rods.

U.S. Pat. No. 2,584,438 discloses a all cabinet with a clam shell-hinted door that includes storage space. The depth of the door is less than that of the cabinet.

Advertisements from the American Girl Collection catalog disclose toy wardrobes of wood that include calm shell-hinged front and rear portions of approximately equal depth. One of the portions includes a clothes rod extending from the front to the back, and the other portion includes shelves and drawers.

While the above-described containers have addressed some of the problems involved in clothes storage, transportation, and display, there remains a need for improved articles of this type.

When it is necessary to transport an display clothes, it would be desirable to minimize the number of operations involved in setting up the clothing display after transportation. In particular, it would be advantageous to be able to simply open up a clothes transportation box and having the clothing ready for display without substantial rearrangement of the contents.

Accordingly, one of the objects of the present invention is to provide a container that facilitates storage, transportation, and display of clothing.

It is another object of the present invention to provide a container that allows display of clothes after their transportation without time-consuming rearrangement of the clothes and without complicated setup of the display.

SUMMARY OF THE INVENTION

The above and other objects of the present invention ave been accomplished by the present invention, which provides a box for storing, transporting, and displaying clothes, which includes:

rectangular front and rear portions, the front portion comprising left and right portions, each of which is hingeably connected at its side to the rear portion so as to permit the left and right portions to be opened so that they are aligned and parallel with the rear portion;

a first hanger rod located inside the rear portion, which extends across the width of the rear portion, and second and third hanger rods located inside the left and right portions of the front portion, respectively, the second and third hanger rods extending across the width of the left and right potions, wherein when the left and right portions are fully opened, the first, second and third hanger rods form a substantially continuous hanger rod extending across the combined width of the rear portion and the left and right portions of the front portion.

Clothing may be transported in the clothes box by hanging the articles of clothing on hangers which in turn hang from the hanger rods. After the clothes have been transported and it is desired to display them, the box can simply be opened up by swinging the left and rear portions of the front portion of the box fully open so tat the hanger rods are aligned. The clothes are then ready for display without rehanging or other time consuming tasks.

BRIEF DESCRIPTION OF THE DRAWINGS

The present invention will become better understood by reference to the following drawings, when.

DESCRIPTION OF THE PREFERRED EMBODIMENTS

The invention now being generally described, the same will be better understood by reference to the following description of certain preferred embodiments, which are included herein for purposes of illustration and to assist one skilled in the art of making and using the invention. The disclosure herein below is not intended to be limiting of the present invention, except where so indicated.

Figure 1:
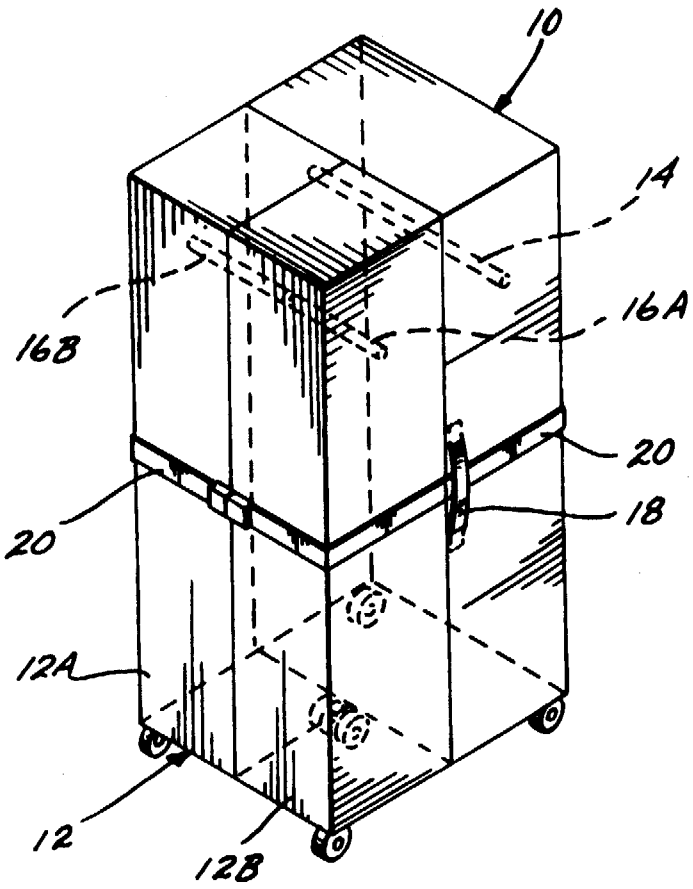
FIG. 1 is a transparent perspective view of the portable closet of the present invention shown in closed position.

Referring now to the drawings, and initially to FIG. 1, there is shown a clothes box for storing, transporting, and displaying clothes. The box includes a rear portion 10 and a front portion 12, preferably of approximately equal depth. The front portion 12 consists of right and left doors 12A and 12B that are joined to and hinged at the rear portion 10 at a score line formed in the opposing side walls of the box. Doors 12A and 12B can be opened from the position illustrated in the drawing to a position where the doors are aligned with and parallel to the rear portion 10, as shown in FIG. 2.

Referring again to FIG. 1, a hanger rod 14 extends across the width of rear portion 10, and hanger rods 16A and 16B extend across the widths of doors 12A and 12B in front portion 12. When the box is being used for transportation r storage of clothes, doors 12A and 12B are closed and the clothes are arranged on hangers supported from hanger rod 14 and hanger rods 16A and 16B.

The box also contains a handle 18 on one of the side walls, and a strap 20 attached to rear portion 10 and adapted to be secured about the entire box. The strap is preferably in the form of a continuous piece of material, the ends of which are able to be fastened or joined together temporarily. For this purpose, one end of the strap could be fitted with a buckle and the other end could contain holes. Likewise, any other fastening means could be used.

Figure 2:
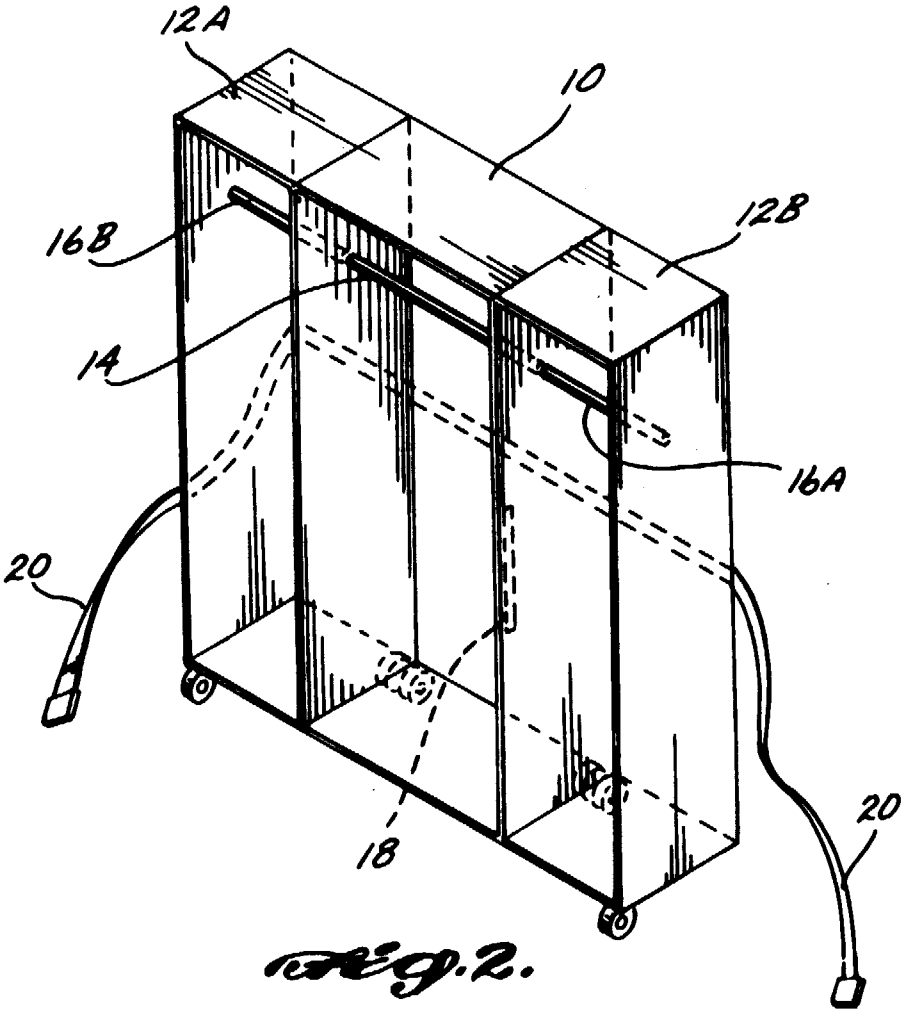
FIG. 2 is a transparent perspective view of the portable closet of the present invention in full opened position.

Referring to FIG. 2, the box shown in FIG. 1 is depicted in fully opened position. It can be seen that hanger rods 14, 16A and 16B form a substantially continuous hanger rod in the fully opened position. Front portions 12A and 12B are also aligned with rear portion 10 to provide a space suitable for display of clothes hung on the hanger rods.

It will be apparent that the portable closet can be made of any materials suitable for this purpose, including, but not limited to plastic, cloth, paper, cardboard, leather or other animal derived products, metal, wood, and the like. Combinations of these materials may also be employed. From the viewpoint of economy of construction and weight, a lightweight wood or cardboard are preferred construction materials. The hanger rods are preferably made out of a lightweight wood. Woven or unwoven cloth may also be employed in the construction of the box, for example, as covering material or for the strap of carrying handle.

The hanger rods may be attached to the sides of the front and rear portions by any convenient attachment means. For example, nails, tacks, staples, screws, glue, brackets of various types, welding material, and other fastening means could be used.

Although in the preferred embodiment a strap is depicted as a means of securing the box in closed position, other securing means can be used. For example, clasps could be employed for this purpose. Preferably, if clasps are used, at least two are utilized. The box may also be provided with a lock in a suitable location to secure the box in a closed position. If a lock is provided, it could be included as part of one or more of the clasps or it could be separate from the clasps.

The box may also be provided with caters, i.e., rollers, on a convenient surface of the box to allow the box to be conveniently transported by rolling. The casters are preferably attached to the bottoms (as shown in FIGS. 1 and 2) of left and right portions 12A and 12B and/or rear portion 10. It is also contemplated to provide a pull-strap for pulling the box when casters are present, in the manner of a transportable suitcase provided with casters and a pull-strap.

While the depicted embodiment contains one set of hanger rods tat form a substantially continuous hanger rod in the open position of the box, additional sets of hanger rods, preferably spaced vertically inside the box could also be provided. In such cases, the fully open box would contain a plurality of substantially continuous rods corresponding to each set of hanger rods. Also, as long as there is at least one set of hanger rods that form a substantially continuous hanger rod in the fully opened box, other single-piece hanger rods may be provided elsewhere in the box, as useful and desired. Additional rods would be specially useful if the clothing being displayed is relatively short as compared to the height of the box, such that all of the clothes could b viewed when the box were opened and the clothes were hanging on the vertically spaced rods.

The dimensions of the box are not necessarily specifically limited and will be determined by the specific use, the nature and size of the clothing articles to be displayed, the ease of transporting the box, and the like. However, in a preferred embodiment, the front and rear portions are about one foot in depth, about four feet in height, and the rewar portion is about 20 inches wide. (Under these circumstances, each of the left and right portions of the front portion would preferably be about ten inches wide).

The box may be utilized to display all manner of garments, including but not limited to shirts, trousers, dresses, bathing suits, belts, ties, underclothes, suits, skirts, blouses, blankets, coats, unfinished material, and the like. An important feature is that the box be capable of transporting and storing the articles to be contained therein, and also be capable of displaying the articles upon opening the box to its fully opened position. Preferably, the articles of clothing will be hung on hangers, and the hangers will be hung on the hanger rods. However, the hanger rods could also be provided with projections an the like for hanging clothes directly thereon.

The invention now having been fully described, it will be appreciated that various changes, substitutions of equivalents, and other modifications will be apparent to one of ordinary skill int he art in view of this disclosure. Accordingly, the invention is to be viewed as limited only to the following appended claims, and equivalents thereof.

The embodiments of the invention in which an exclusive property or privilege is claimed are defined as follows:

1. A box for storing, transporting, and displaying clothes, which comprises:

substantially rectangular front and rear portions, the front potion comprising separate left and right portions, each having sides defining a width and each including means for hingeably connecting the portion to said rear portion so as to permit said left and right portions to be opened so that they are aligned with and parallel to said rear portion;

a first hanger rod located inside said rewar portion, which extends across the width of said rear portion, and second and third hanger rods located inside said left and right portions of said front portion, respectively, said second and third hanger rods extending across the width of said left and right portions, wherein the rods are positioned such that when said left and right portions are fully opened, said first, second, and third hanger rods form a substantially continuous clothes rod extending across the combined width of said rear portion and said left and right portions of said front portion.

2. A box according to claim 1, wherein said left and right portions have substantially the same dimensions.

3. A box according to claim 1, wherein the front and rear portions have substantially the same dimensions.

4. A box according to claim 1, wherein said first hanger rod is located near the top of said rear portion approximately midway between the front and rear of said portion, and said second and third hanger rods are located at substantially the same height as said first hanger rod and approximately midway between the front and rear of said front portion.

5. A box according to claim 1, wherein said first, second, and third hanger rods are attached to said box by securing means at the ends of said rods.

6. The box according to claim 1, which further comprises casters located on the bottom surface thereof that facilitate movement of said box across a surface.

7. A box according to claim 1, which further comprises a strap attached to an exterior surface of said rear portion, the ends of said strap including means for reversible connection and said strap being dimensioned so as to permit securing said left and right portions of said front portion in a closed position.

8. A box according to claim 1, which further comprises a handle attached to an exterior surface of said box to facilitate carrying said box when it is closed.

* * * * *

UNITED STATES PATENT AND TRADEMARK OFFICE

CERTIFICATE OF CORRECTION

PATENT NO. : 5,129,491

DATED : July 14, 1992

INVENTOR(S) : E. A. Seidman

It is certified that error appears in the above-identified patent and that said Letters Patent is hereby corrected as shown below:

| COLUMN | LINE | ERROR |
|---|---|---|
| 1 | 12 | "ben" should be --been-- |
| 1 | 14 | "example" should be --example,-- |
| 1 | 20 | "aligned with the" should be --aligned with and-- |
| 1 | 43 | "all" should be --wall-- |
| 1 | 44 | "hinted" should be --hinged-- |
| 1 | 48 | "calm" should be --clam-- |
| 1 | 56 | "an" should be --and-- |
| 1 | 61 | "having" should be --have-- |
| 2 | 6 | "ave" should be --have-- |
| 2 | 31 | "tat" should be --that-- |
| 2 | 37 | "when" should be --wherein-- |
| 3 | 2 | "r" should be --or-- |
| 3 | 25 | "animal derived" should be --animal-derived-- |
| 3 | 48 | "caters" should be --casters-- |
| 3 | 58 | "tat" should be --that-- |
| 3 | 68 | "specially" should be --especially-- |
| 4 | 11 | "rewar" should be --rear-- |
| 4 | 26 | "an" should be --and-- |
| 4 | 30 | "int he" should be --in the-- |
| 4 | 41 | "potion" should be --portion-- |

UNITED STATES PATENT AND TRADEMARK OFFICE

CERTIFICATE OF CORRECTION

PATENT NO. : 5,129,491

DATED : July 14, 1992

INVENTOR(S) : E. A. Seidman

It is certified that error appears in the above-identified patent and that said Letters Patent is hereby corrected as shown below:

| COLUMN | LINE | |
|---|---|---|
| 4 | 47 | "rewar" should be —rear— |

Signed and Sealed this

Twelfth Day of October, 1993

Bruce Lehman

*Attest:*

BRUCE LEHMAN

*Attesting Officer*

*Commissioner of Patents and Trademarks*